US006116253A

United States Patent [19]

Armstrong

[11] Patent Number: 6,116,253

[45] Date of Patent: Sep. 12, 2000

[54] PEDICURE SLIPPER

[76] Inventor: Maggie Armstrong, 181 Caine St., Battle Creek, Mich. 49014

[21] Appl. No.: 09/395,424

[22] Filed: Sep. 14, 1999

[51] Int. Cl.[7] ..... A45D 44/00; A43B 3/12; A43B 21/36; A43B 7/14

[52] U.S. Cl. ..... 132/333; 36/11.5; 36/88; 36/94

[58] Field of Search ..... 132/333; 36/11.5, 36/94, 9 R, 8.1

[56] References Cited

U.S. PATENT DOCUMENTS

| | | | |
|---|---|---|---|
| 1,402,375 | 1/1922 | Parish | 36/94 |
| 1,867,679 | 7/1932 | Riehle et al. | 36/94 |
| 2,740,207 | 4/1956 | Starensier | 36/94 |
| 2,932,097 | 4/1960 | George | 36/11.5 |
| 3,675,346 | 7/1972 | Miyachi et al. | 36/11.5 |
| 4,017,987 | 4/1977 | Perez et al. | 36/11.5 |
| 5,615,496 | 4/1997 | Sharpstein | 36/11.5 |
| 5,870,837 | 2/1999 | Poulos | 36/11.5 |
| 5,913,592 | 6/1999 | Moore | 36/8.1 |

*Primary Examiner*—John J. Wilson
*Assistant Examiner*—Robyn Kieu Doan
*Attorney, Agent, or Firm*—Flynn, Thiel, Boutell & Tanis, P.C.

[57] ABSTRACT

A reusable pedicure slipper is made up of a sole upon which a foot is supported and first and second cords. The first cord is used to separate the toes of the foot and can either be wrapped around the individual toes or form loops in which the individual toes are placed. The second cord is positioned behind the first cord and is tied around the ankle of the user to help secure the sole to the foot of the user.

6 Claims, 1 Drawing Sheet

PEDICURE SLIPPER

FIELD OF THE INVENTION

The present invention relates to a reusable pedicure slipper and a method of performing a pedicure using this slipper and, more specifically, to a pedicure slipper made up of a sole member and first and second cords and a method of applying a pedicure utilizing this pedicure slipper.

BACKGROUND OF THE INVENTION

In today's fashion-conscious society, both men and women are putting increased efforts in bettering their personal appearance. That is, manicures and pedicures, which were once only reserved for the affluent, are now being routinely obtained by the middle class and even people having a low income. In particular, pedicures have become very popular with both men and women as a standard course of personal grooming.

In order for a proper pedicure to be performed, the toes of the foot must be separated in order to enable easier access to the nails of the toes. Moreover, if a polish is applied to the nails of the toes, the toes must be maintained in a separated condition and prevented from coming into contact with anything else while the polish is allowed to dry. This requires that the person who has received the pedicure effectively be immobilized during the period of time that it takes for the polish to dry. This is extremely inefficient as the person who receives the pedicure would most certainly be doing other things if it were not for the fear of smearing the polish. Therefore, there is a need for a pedicure implement which maintains the toes of the foot in a separated condition and yet still allows the person who receives the pedicure treatment to be mobile.

SUMMARY OF THE INVENTION

It is an object of the present invention to provide a pedicure slipper which maintains the toes of the foot in a separated condition and yet enables the wearer to be mobile.

It is a further object of the present invention to provide a method of performing a pedicure in which the pedicure slipper of the present invention is utilized.

These and other objects of the present invention are satisfied by providing a pedicure slipper comprising a sole member, a first cord slidably engaged with the sole member for separating the toes of the wearer and a second cord member slidably engaged with the sole member at a position rearward from the first cord and a method of performing a pedicure using the pedicure slipper.

DETAILED DESCRIPTION OF THE INVENTION

Figure 1:
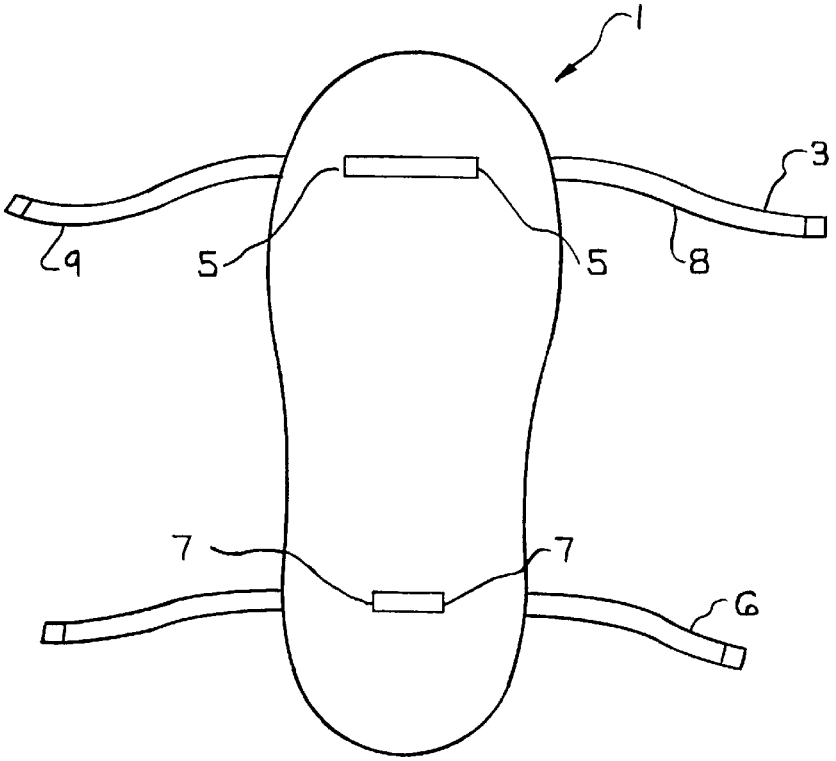
FIG. 1 illustrates a pedicure slipper according to a first embodiment of the present invention.

FIG. 1 illustrates a pedicure slipper 1 according to a first embodiment of the present invention. This pedicure slipper 1 comprises a sole member 2 configured in the shape of a foot, a first cord 3 which passes through slots 5 provided at a front portion of the sole member 2 and a second cord 6 which passes through slots 7 provided at a rear portion of the sole member 2.

The first cord 3 has a long portion 8 and a short portion 9 extending beyond the width of the sole member 2. The long portion 8 is provided adjacent the little toe of the wearer and is brought over the little toe, under the next adjacent toe, over the next adjacent toe, under the next adjacent toe and over the big toe to separate the toes from each other. The long portion 8 of the cord is then tied to the short portion 9 of the cord. The second cord 6 is then tied around the ankle of the wearer by crossing its ends in front of the ankle and tieing the two ends in back of the ankle to secure the pedicure slipper 1 to the foot of the wearer.

A second way of separating the toes of the wearer using the first embodiment of the present invention involves the steps of positioning the long portion 8 of the first cord 3 so that it is positioned adjacent to the little toe of the wearer, bringing the long portion 8 of the first cord 3 under the little toe, over the next adjacent toe, under the next adjacent toe, over the next adjacent toe and under the big toe and tieing the long portion 8 and the short portion 9 of the first cord 3 together.

Figure 2:
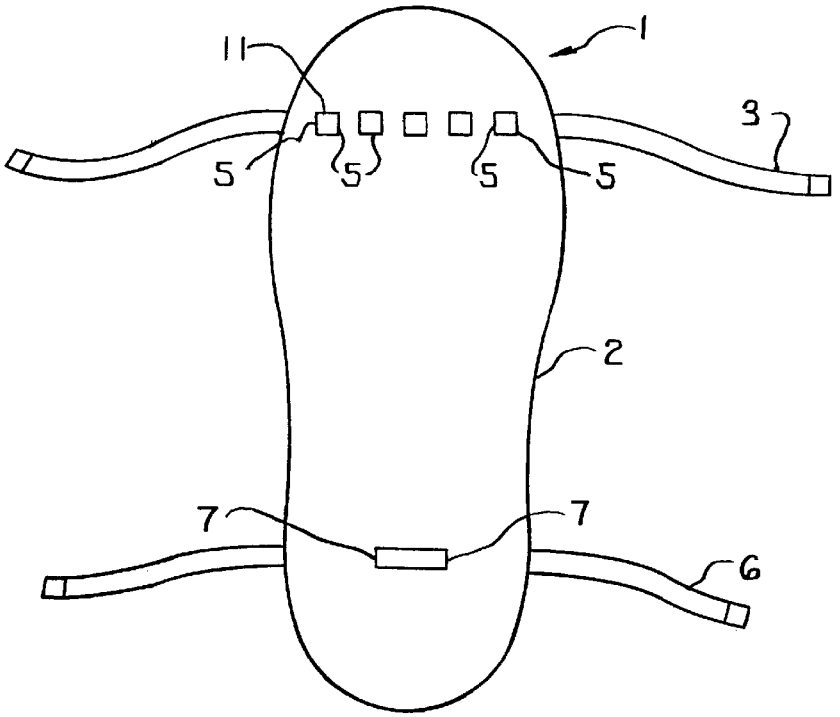
FIG. 2 illustrates a pedicure slipper according to a second embodiment of the present invention.

A second embodiment of the pedicure slipper 1 of the present invention is illustrated in FIG. 2. This pedicure slipper 1 also comprises a sole member 2 configured in the shape of a foot, a first cord 3 which passes through slots 5 provided in the sole member 2 and a second cord 6 which passes through slots 7 provided in the sole member 2 at a position rearward from the first cord 3. In this second embodiment of the present invention, the first cord 3 passes through the slots 5 to form five loops 11 on the sole member 2. The loops 11 are adjusted so that a toe can be inserted into each loop and the ends of the first cord 3 tied together to help secure the sole member 2 to the foot of the wearer. The second cord member 6 is then tied around the ankle of the wearer in the same manner as discussed above for the first embodiment of the present invention. The cords 3, 6 are slidably engaged in the slots 5, 7 provided in the sole member 2 and can be adjusted according to the toe size of the wearer. The cords and sole member can be made of any suitable material and preferably is a polymeric material, a rubber or a fibrous material such as cotton or a cellulosic material. The bottom of the sole member 2 can either be roughened or coated with a material having a high coefficient of friction in order to give the bottom of the sole member better traction.

An advantage of the pedicure slipper of the present invention is that the cords 3 and 6 and the sole member 2 can be replaced if they become soiled, physically damaged or otherwise unsuitable for use. That is, if cord 3 and/or cord 6 become unsuitable for use, the pedicure slipper 1 does not have to be replaced. The old cords can be removed from the sole member 2 and new cords inserted in their place. Likewise, if the sole member 2 becomes unsuitable for use, the cords 3 and 6 can be removed therefrom and inserted into a new sole member 2. As such, the pedicure slipper of the present invention is not only easy to use, it is economical.

Although specific embodiments of the present invention have been described for illustrative purposes only, it would be well within the skill of the art to modify various features of the present invention without departing from the spirit and scope thereof.

What is claimed is:

1. A method of performing a pedicure comprising the steps of providing a sole member having a first cord which slidably passes through a forward portion of the sole member at least two times;

bringing a foot into contact with an upper surface of the sole member;

separating each toe of the foot from each other with the first cord; and performing the pedicure on the foot.

2. The method of claim 1, additionally comprising the step of tieing the first cord to secure the sole member to the foot.

3. The method of claim 2, additionally comprising the steps of providing a second cord which slidably passes through a rearward portion of the sole member at least two times and tieing the second cord to secure the sole member to the foot.

4. A method of performing a pedicure comprising the steps of providing a sole member having a first cord which slidably passes through a forward portion of the sole member at least two times and has the ends thereof extending beyond opposite sides of the sole member;

bringing a foot into contact with an upper surface of the sole member;

passing one end of the cord under and over adjacent toes of the foot to separate the adjacent toes from each other; and performing the pedicure on the foot.

5. The method of claim 4, additionally comprising the step of tieing the first cord to secure the sole member to the foot.

6. The method of claim 5, additionally comprising the steps of providing a second cord which slidably passes through a rearward portion of the sole member at least two times and tieing the second cord to secure the sole member to the foot.

* * * * *